US006079578A

United States Patent [19]

Dyson

[11] Patent Number: 6,079,578

[45] **Date of Patent: *Jun. 27, 2000**

[54] MULTIDIRECTIONAL, SWITCHLESS OVERHEAD SUPPORT SYSTEM

[76] Inventor: Donald J. Dyson, 1975 Sorrontino Dr., Escondido, Calif. 92025

[ * ] Notice: This patent is subject to a terminal disclaimer.

[21] Appl. No.: 09/135,380

[22] Filed: Aug. 17, 1998

Related U.S. Application Data

[63] Continuation-in-part of application No. 09/067,079, Apr. 27, 1998.

[51] Int. Cl.[7] ..... A61G 7/10

[52] U.S. Cl. ..... 212/336; 5/83.1; 104/89; 105/148; 105/177; 212/71; 212/338

[58] Field of Search ..... 212/331, 332, 212/337, 336, 270, 271, 71; 104/89, 182; 105/148, 177; 198/608; 5/83.1, 86.1

[56] References Cited

U.S. PATENT DOCUMENTS

| | | | |
|---|---|---|---|
| 904,119 | 11/1908 | Downs | 104/182 |
| 2,943,579 | 7/1960 | Geddes | 212/346 |
| 3,253,552 | 5/1966 | Stein | 104/94 |
| 3,974,776 | 8/1976 | Deivernoise | 104/26.2 |
| 4,243,147 | 1/1981 | Twitchell et al. | 5/89.1 |
| 4,401,033 | 8/1983 | Gerkin | 104/94 |
| 4,752,987 | 6/1988 | Dreyer et al. | 104/94 |
| 4,796,765 | 1/1989 | Mayne | 212/337 |
| 5,038,425 | 8/1991 | Merry | 5/83 |
| 5,404,992 | 4/1995 | Robu | 198/465.4 |

*Primary Examiner*—Thomas J. Brahan
*Attorney, Agent, or Firm*—John R. Ross; John R. Ross, III

[57] ABSTRACT

An overhead support system. A riding surface is located over a space and supports at least one overhead cart from which a load is supported by a tension element. The load can be moved horizontally in the space by applying a horizontal force to the load causing the cart to move over the riding surface while carrying the load in the horizontal direction. In preferred embodiments the riding surface is an array of spoked rimless wheels. In other preferred embodiments the riding surface is a slot track, or the riding surface may be a combination of the array and slot tracks. In preferred embodiments casters are mounted on the top of the riding surface to permit easy horizontal movement of the cart over the casters. In other preferred embodiments the riding surface is flat and casters are mounted on the bottom of the overhead cart.

20 Claims, 18 Drawing Sheets

MULTIDIRECTIONAL, SWITCHLESS OVERHEAD SUPPORT SYSTEM

This is a continuation-in-part application of Ser. No. 09/067,079 filed Apr. 27, 1998.

This application relates to support systems and in particular to overhead support systems.

BACKGROUND OF THE INVENTION

A substantial portion of the population of the world has great difficulty in walking. A huge number cannot walk at all. These groups are forced to rely on attendants or mechanical devices such as crutches or wheelchairs for their ambulation. Included are those with ambulation problems due to recent hip and knee replacement surgery.

When a person is not able to walk for a period of several weeks or months, his leg muscles tend to degenerate unless physical therapy is provided. If the leg muscles degenerate, extensive physical therapy may be required to enable him to regain his ability to walk. Many people never walk again after an extensive period of relying on a wheel chair for transportation.

The prior art includes overhead support systems. These typically include an overhead track with some type of cart riding on the track with a load (which could be a person) suspended from the cart through a suspension tether. Many such systems exist in automated factories. A typical prior art overhead transport system is found by reference to U.S. Pat. No. 5,404,992. This reference discloses a suspension conveyor system comprising a conveyor device that rolls along a track rail. A major disadvantage of this design, and others like it, is that when tracks intersect, the user must select which track to take by a switching means. The switching means tends to be complicated, costly and subject to failure.

Automatic tensioning assemblies are commonly found in prior art overhead transportation systems. Generally, a tensioning assembly will maintain a set load under tension based on the load cell read-out from the torque on the tensioning assembly's drive motor. Usually, a hand held remote is used to set the load, and raise and lower the object being carried by the transportation system.

What is needed is a better overhead support system that allows for movement between intersecting tracks without switches.

SUMMARY OF THE INVENTION

The present invention provides an overhead support system. A riding surface is located over a space and supports at least one overhead cart from which a load is supported by a tension element. The load can be moved horizontally in the space by applying a horizontal force to the load causing the cart to move over the riding surface while carrying the load in the horizontal direction. In preferred embodiments the riding surface is an array of spoked rimless wheels. In other preferred embodiments the riding surface is a slot track, or the riding surface may be a combination of the array and slot tracks. In preferred embodiments casters are mounted on the top of the riding surface to permit easy horizontal movement of the cart over the casters. In other preferred embodiments the riding surface is flat and casters are mounted on the bottom of the overhead cart.

DETAILED DESCRIPTION OF PREFERRED EMBODIMENTS

Preferred embodiments of the present invention can be described by reference to the drawings.

First Preferred Embodiment

Figure 1A:
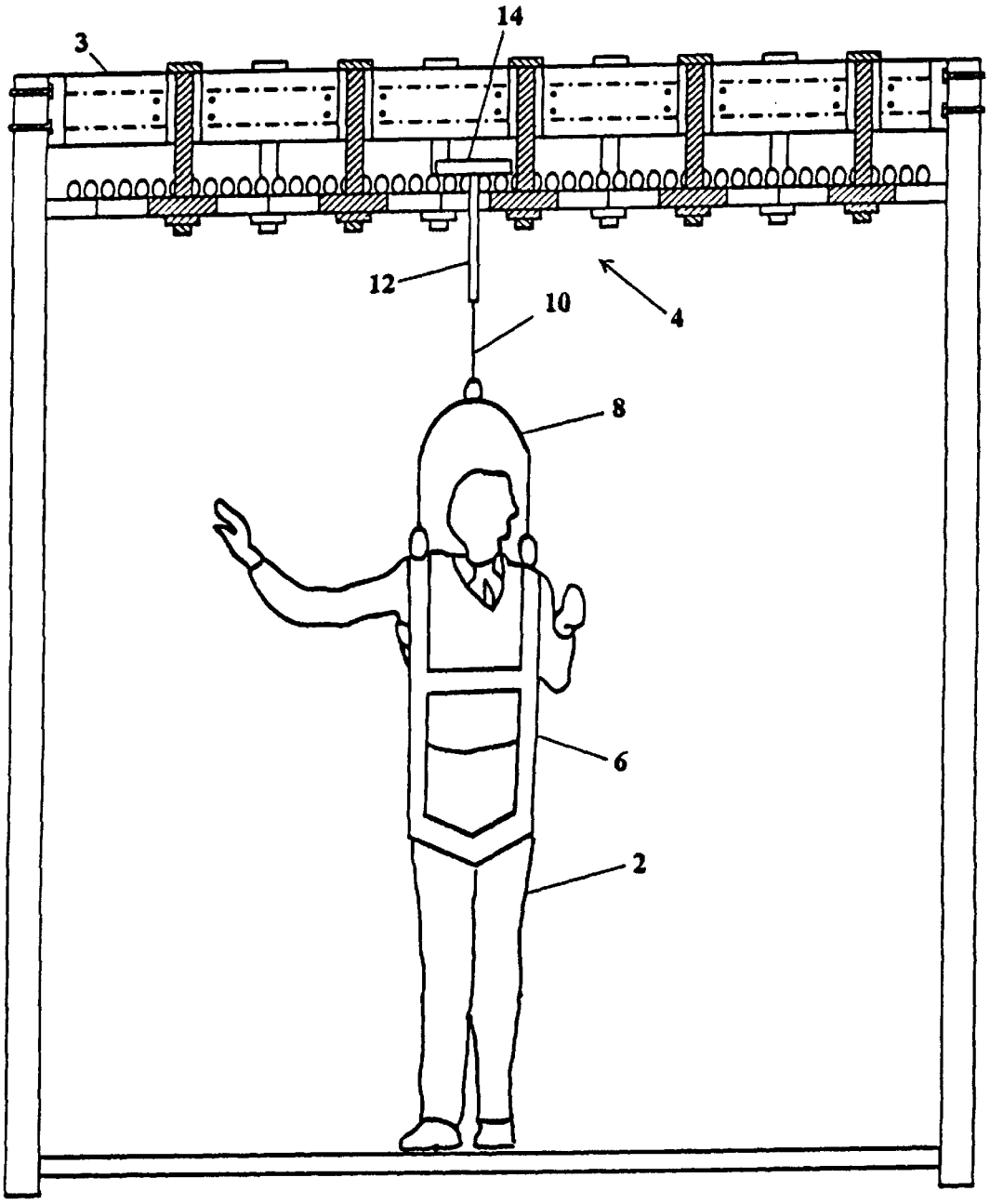
FIG. 1A shows a first preferred embodiment of the present invention.

A first preferred embodiment of the present invention can be described by reference to FIGS. 1A through 4B. As shown in FIG. 1A, a person 2 is partially supported by overhead support system 4. This system is installed near the ceiling of a small room (specifically, in this particular embodiment, about 8 feet [100.25 inches] by about 9.5 feet [114.50 inches]). The person 2 wears a parachute type harness 6 to which is attached curved support bar 8 which is in turn attached to support cable 10. Support cable 10 passes through cart tube 12, which is an integral part of overhead cart 14.

Figure 2A:
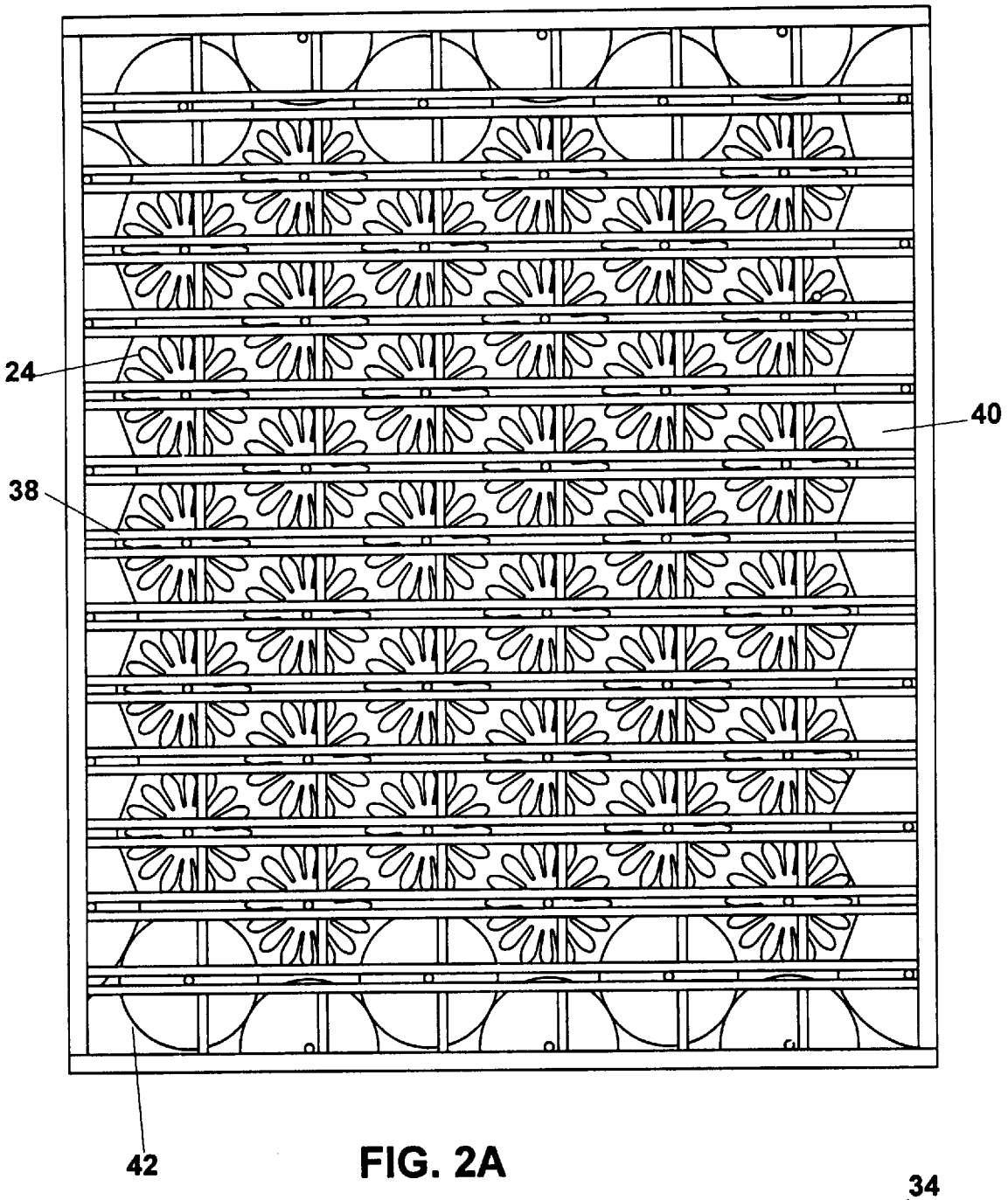
FIG. 2A shows an array of daisy wheels.

The small room depicted in FIG. 1A and also in FIG. 2A is outfitted with thirty-three daisy wheels 24 as shown in FIG. 2. The thirty-three daisy wheels 24 define the riding surface upon which overhead cart 14 rides. A daisy wheel assembly is shown in FIG. 4.

Figure 2B:
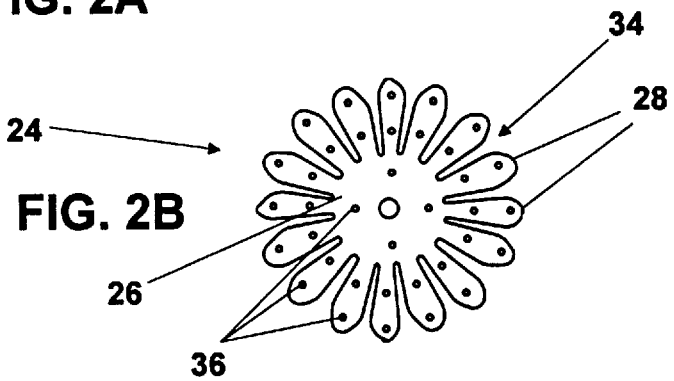
FIG. 2B is a top view of a single daisy wheel.
Figure 4B:
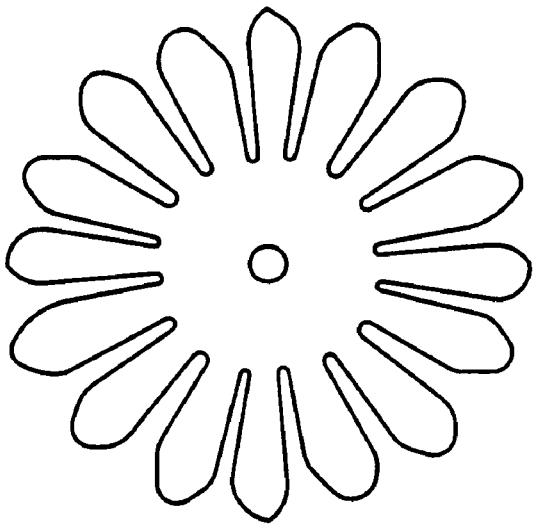
FIG. 4B is a bottom view of a daisy wheel.
Figure 4A:
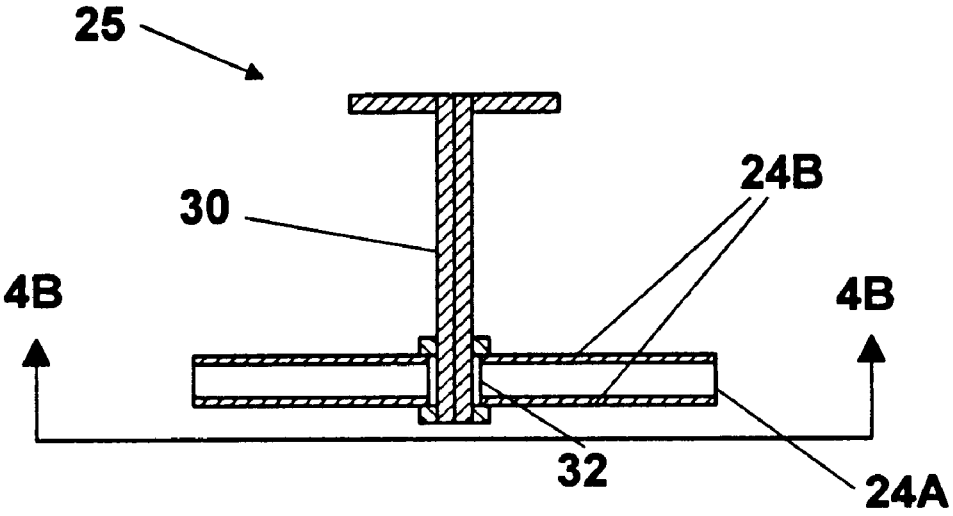
FIG. 4A shows a daisy wheel assembly.

A top view of one daisy wheel 24 is shown in FIG. 2B. Each daisy wheel 24 is comprised of an approximately circular inner frame 26 having a 6-inch diameter and 16 5-inch spokes 28 to produce a daisy wheel diameter of 16 inches. Each daisy wheel 24 is rotationally mounted on an 18-inch 1-inch diameter steel support rod 30. Easy rotation is provided with a bushing type bearing 32 as shown in FIG. 4A. The daisy wheel in this embodiment is comprised of a laminated structure with a 2-inch thick wood core 24A with 0.1-inch steel plates 24B on top and bottom as shown in FIG. 4. Other materials such as aluminum, steel or fiber plastic may be used. In this embodiment spokes 28 are petal shaped as shown in FIG. 2B and all 16 of them together define sixteen ½-inch slots 34 as also shown in FIG. 2B. Mounted on top of daisy wheel 24 are thirty-six casters 36, as shown in FIGS. 1A and 2B. These are inexpensive commercially available casters each having an 11/16-diameter roller ball mounted in a metal frame with the roller ball riding on three smaller ball bearings. The roller ball and the ball bearings and frame are supported by a threaded bolt which is used to attached the caster to daisy wheel 24. These casters are available from suppliers such as Acme Caster Company with offices in Paughkeepsee, N.Y.

Figures 1B, 1C, 1D, 1E:
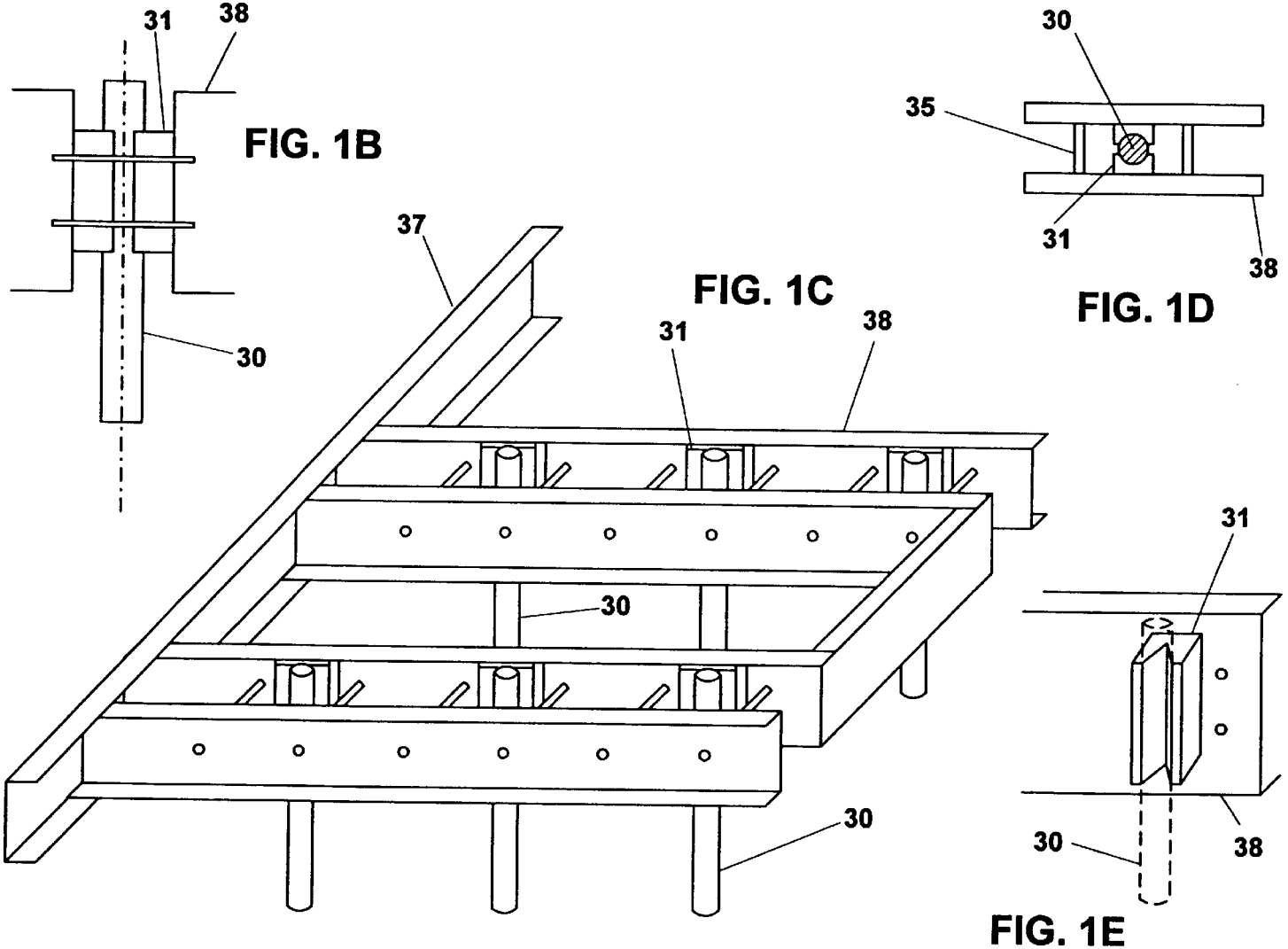
FIGS. 1B–1E shows the vertical support rod fastened to the channel shaped beams.
Figure 1F:
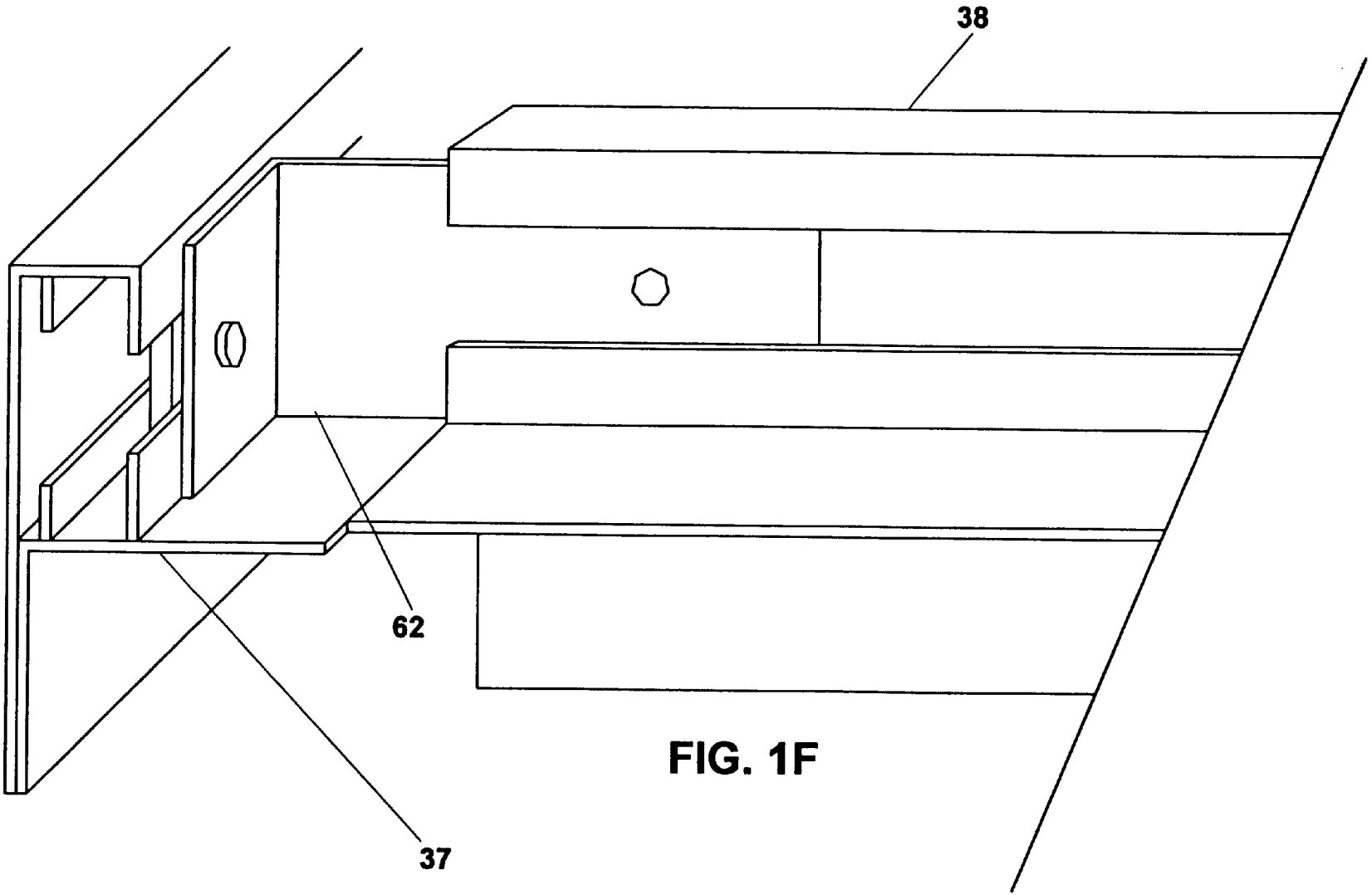
FIG. 1F shows the channel shaped beams connected to the perimeter beam.

Each 18-inch steel rod 30 is attached to one of eleven 8-foot overhead beams 38. Channel shaped beams 38 holding steel rods 30 are fitted with V-wedge blocks welded in a vertical position on the back side of horizontal beams 38 as shown in FIG. 1E and spaced to the pitch of the daisy wheels, as shown in FIG. 2A. Two channels are bolted together with bolts 35 and steel rods 30 are held by V-wedges 31 in a vertical position, as shown in FIG. 1D. V-wedge 31 spacing alternates with each adjoining beam 38 to form a triangular pitch of rods 30. Channel beams 38 (2 channels back-to-back) are supported at the edge of the room by a single perimeter channel 37 attached to wall studs, as shown in FIG. 1C. Clip angles 62 are used to attach channel shaped beams 38 to perimeter channel 37, as shown in FIG. 1F.

In this embodiment, the bottom surface of overhead cart is flat and rides on casters 36 mounted on the thirty-three daisy wheels 24 and shelves 40 and circular supports 42, as shown in FIGS. 1A and 2A.

Person 2 shown in FIG. 1A is supported by overhead support system and, with minimal stress, he can walk about in the room. Person 2 is free to go anywhere in the room except directly below the center of each daisy wheel. Preferably the overhead support system would extend at least from the persons bed to his bathroom and his eating area. This would permit him to be relatively independent. It should be noted that person 2 might sit down in a chair or lie down in a bed while continuing to be supported by overhead support system 2 provided the chair or bed is at a desired height. It should be noted that more than one person could be supported by overhead support system 4. In fact in a retirement or medical facility with many patients, a large number of persons could be using the system simultaneously.

Second Preferred Embodiment

Figure 3A:
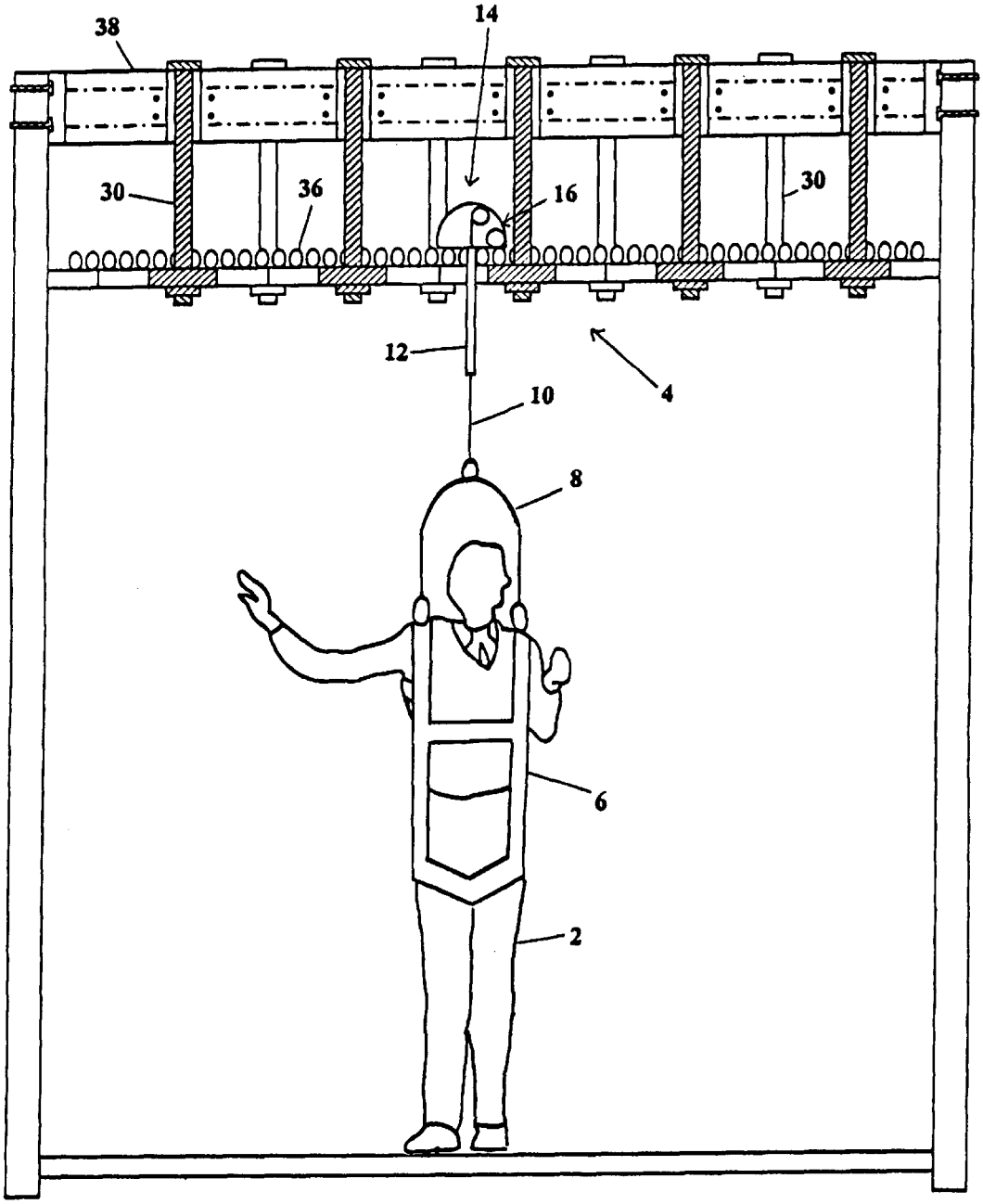
FIGS. 3A–3B shows a second preferred embodiment of the present invention.
Figure 3B:
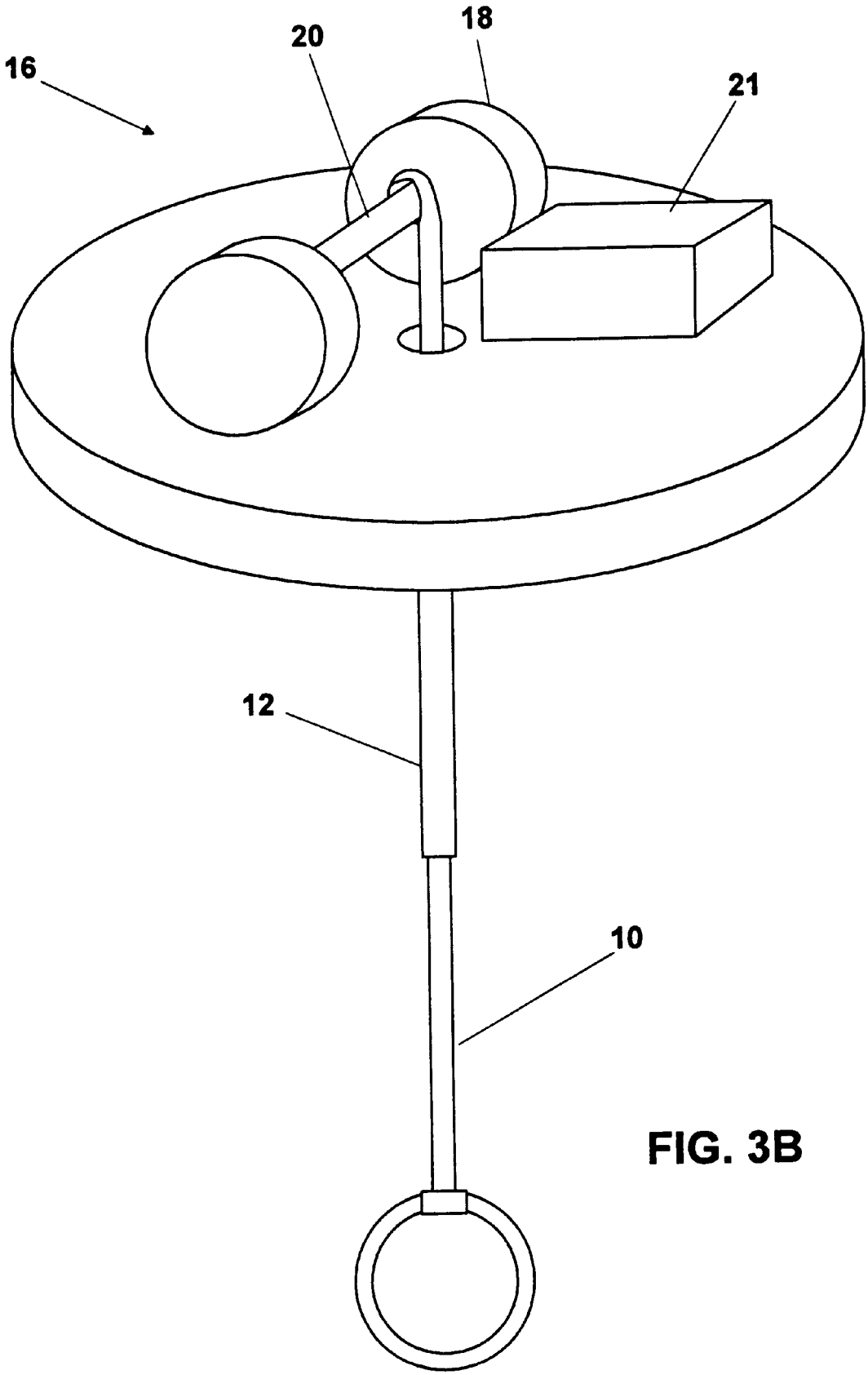

A second preferred embodiment can be described by reference to FIGS. 3A and 3B. The system is similar to the first preferred embodiment described above except this embodiment comprises a motor driven tension assembly 16. Mounted on overhead cart 14 is tension assembly 16, which is programmed to provide a constant tension on support cable 10. In a preferred embodiment that tension is 100 pounds (with capacity for 500 lbs.). Tension assembly 16 is shown in more detail in FIG. 3E, and comprises take-up axis 20 and drive motor 18, which is powered by rechargeable battery 21. Tension assembly 16 is capable of raising and lowering support cable 10 from 14 inches to 72 inches.

Tension assembly 16 is controlled by a set load based on load cell read-out from torque on drive motor 18. A hand held remote control unit is used to set load, raise or lower cable 10.

With tension assembly 16, person 2 shown in FIG. 1A who (for example) weighs 150 pounds is now receiving 100 pounds of support from overhead transportation system 2. This person's own legs now have to support only 50 pounds. Thus, with minimal stress person 2 can walk about in the room. Person 2 is free to go anywhere in the room except directly below the center of each daisy wheel. Of course, the tension on support cable 10 can be adjusted to any value up to the weight of person 2. Recommended tensions would vary from about 90 percent of the person's weight to about 20 percent of the person's weight. Preferably the overhead support system would extend at least from the persons bed to his bathroom and his eating area. This would permit him to be relatively independent. It should be noted that person 2 might sit down in a chair or lie down in a bed while continuing to be supported by overhead support system 2. Tension assembly 16 automatically extends support cable 10 to permit sitting or lying down. This embodiment also includes a hand-held remote control unit and a detector mounted on tube 12 with which person 2 can de-energize tension assembly 16 or change the tension applied by it. It should be noted that more than one person could be supported by overhead support system 4. In fact in a retirement or medical facility with many patients, a large number of persons could be using the system simultaneously.

Third Preferred Embodiment

Figure 5A:
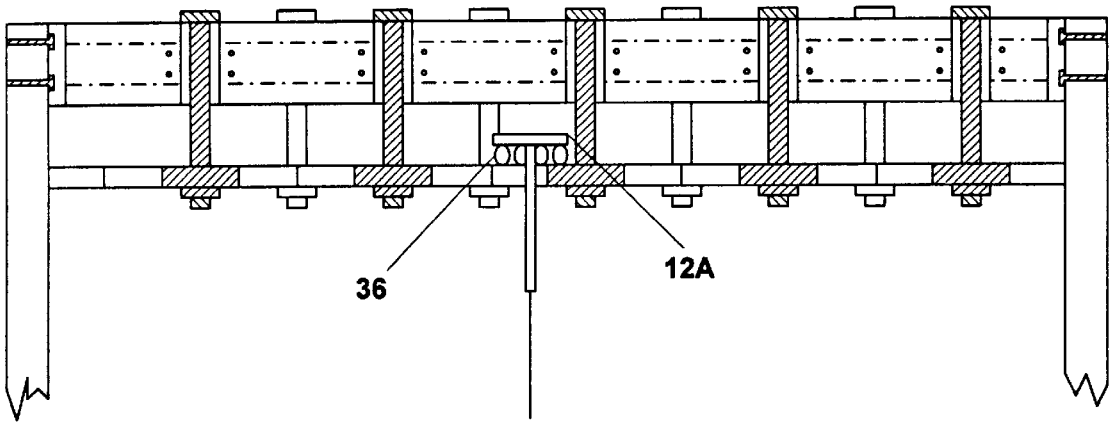
FIG. 5A shows a third preferred embodiment of the present invention without a motor driven tensioning assembly.
Figure 5B:
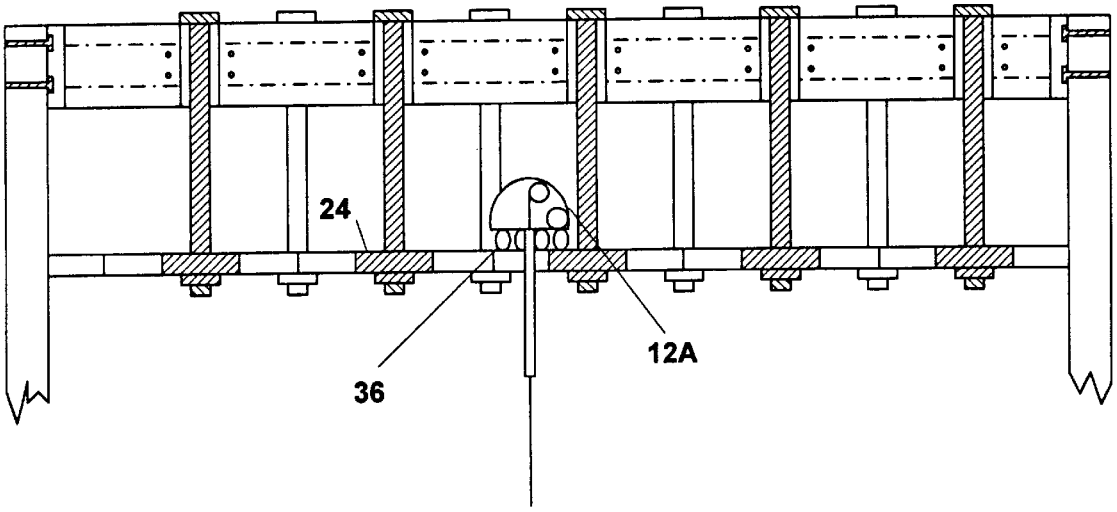
FIG. 5B shows a third preferred embodiment of the present invention with a motor driven tensioning assembly.

A third preferred embodiment of the present invention may be described by reference to FIGS. 5A and 5B. This embodiment is exactly the same as the first embodiment except in this case the Casters 36 are mounted on the bottom of cart 12A and the tops of the daisy wheels 24 the shelves 40 and circular wheels 42 are flat, with no casters 36.

Star Shaped Spoked Wheels

Figure 6:
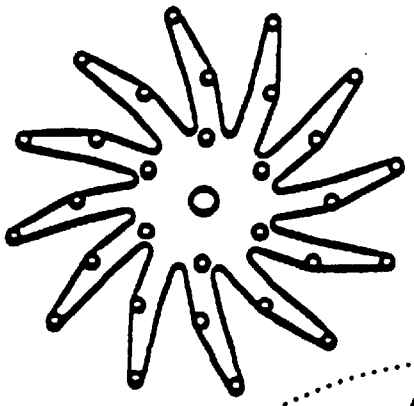
FIG. 6 shows an alternate design of a daisy wheel.

Another preferred embodiment, especially useful if casters 36 are mounted on the spoked wheel is to utilize a spoked wheel in the general shape of an ornamental star (or spider) as shown in FIG. 6. The points (or legs) of the star can be generally straight or angled as shown in FIG. 6. The angled shape of the legs encourages rotary motion of the spoked wheels as the cart is moved above the wheels.

Other Daisy Wheel Designs

Figure 7A:
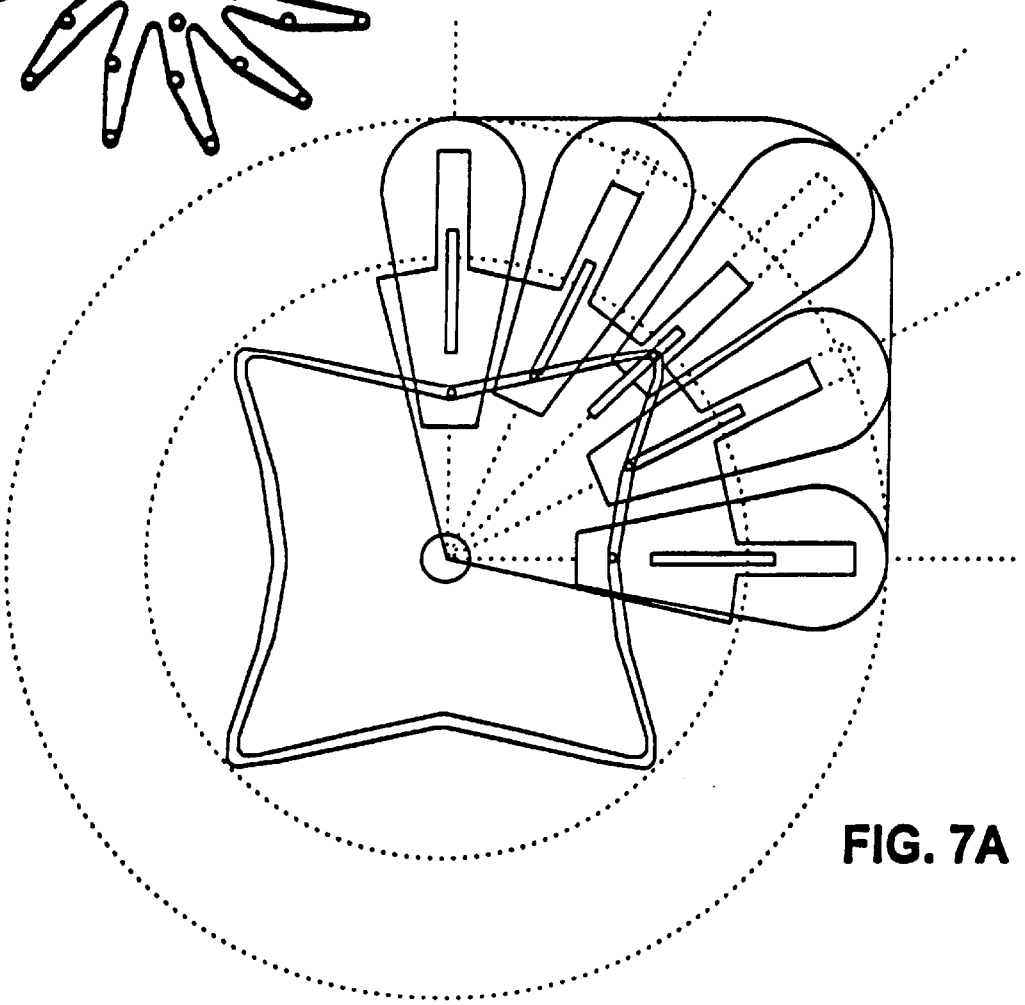
FIGS. 7A and 7B show views of a daisy wheel with telescoping spokes.
Figure 7B:
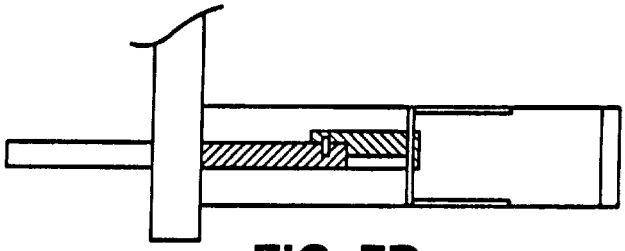

Many modifications to the basic daisy wheel design described above could be made. Other bearing arrangements would work. For example ball bearings instead of bushing type bearings could be used. The daisy wheel part of the daisy wheel assembly could be rigidly attached to support rod 30 and a bearing arrangement mounted at the top of rod 30 could permit rotation of rod 30 along with daisy wheel 24. The spokes of daisy wheel 24 could be offset from radial directions as shown in FIG. 6. It is believed that this design would tend to guide the cart around a support when a person is headed straight toward it. The spokes of daisy wheel 24 could be designed to telescope in and out as the daisy wheel rotates in order to substantially fill the ceiling space. Such a design is shown in FIGS. 7A and 7B. This feature substantially complicates the design of the daisy wheel but would permit use of carts with smaller bottom surface areas. Applicant refers to the daisy wheel array shown in FIG. IA as a triangular array. Other arrays are possible, such as a rectangular array. However, the rectangular array produces more open space for the cart to cross.

Design Parameters

Preferably the support system for use to support people is designed to withstand a dynamic load of at least 1000 pounds, preferably 2000 pounds. Users should be able to move through the room at speeds of at least 30 feet per minute. The Tether system should be able to lift a person from a prone position on the floor to a full standing position. The support system should be modular in design to fit rooms from 30 square feet to 200 square feet of various widths and lengths. Several people should be able to use the system simultaneously. The system should allow two persons to pass in a four-foot wide hallway. The system should be easy to install (for example) in a 200 square foot room by two people in about 4 hours. In the above embodiment the maximum deflection of the tips of the daisy wheels is estimated to be about 1/32 inch with a 300-pound load.

Other Cart Designs

Figure 8:
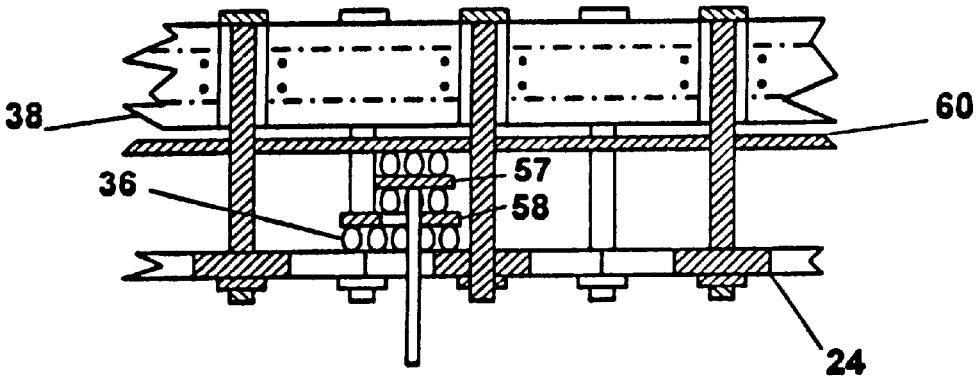
FIG. 8 shows a fourth preferred embodiment of the present invention.
Figure 9A:
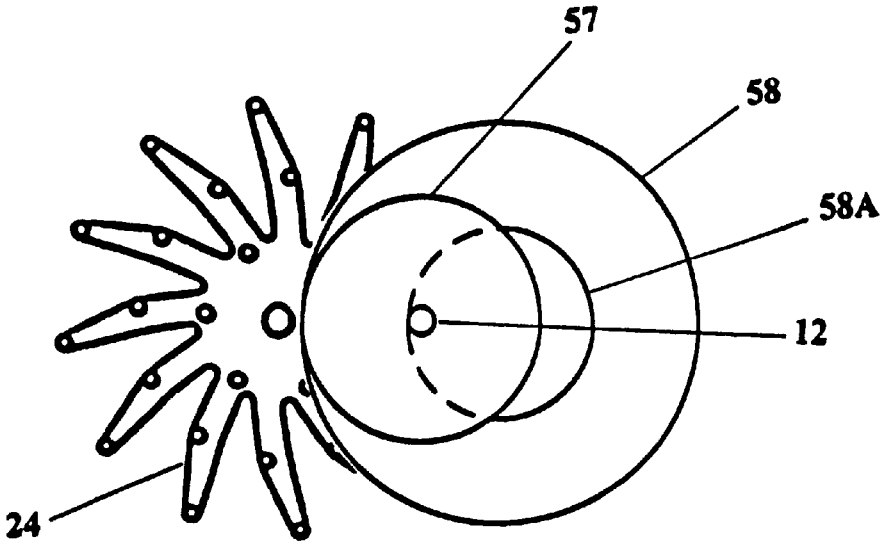
FIGS. 9A and 9B show the top cart, center hole cart and daisy wheel.
Figure 9B:
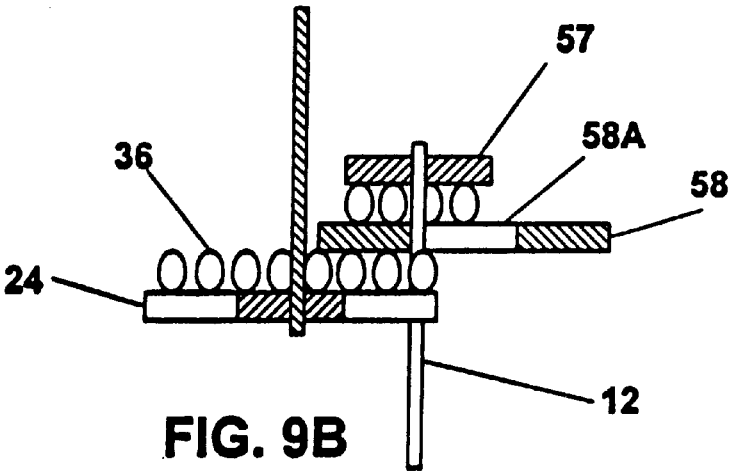
Figure 10:
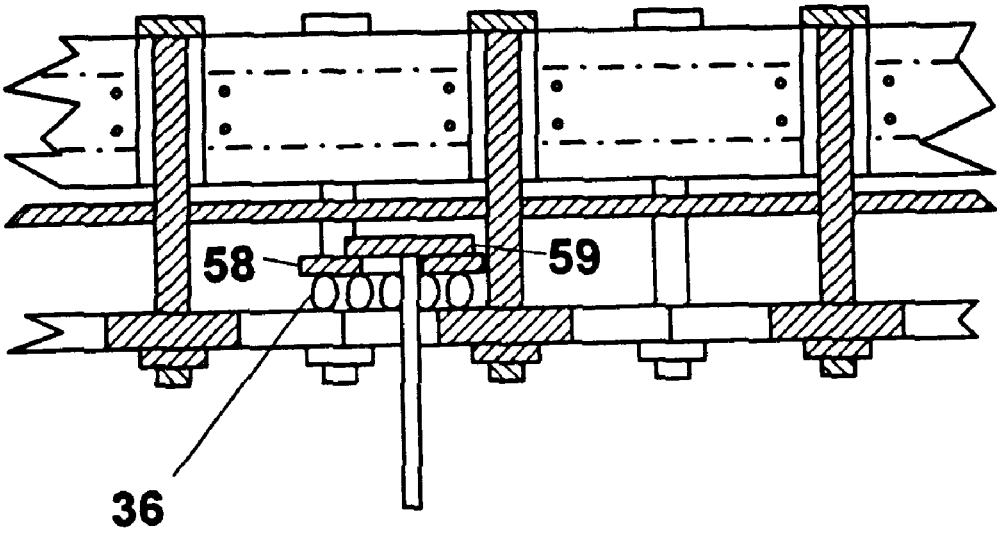
FIG. 10 shows a fifth preferred embodiment of the present invention.

Various other cart designs are possible. For example, in some applications a hoist may not be needed or could be located below daisy wheels 24. With the hoist eliminated or located beneath the daisy wheels 24, the distance between the daisy wheels 24 and channel shaped beams 38 can be lessened, or a double layered cart as shown in FIG. 8. In FIG. 8, casters 36 roll in-between daisy wheels 24, center hole cart 58 and top cart 59. Also, casters 36 roll between top cart 59 and false ceiling 60 for greater stability. FIGS. 9A and 9B further illustrate the function of top cart 59 and center hole cart 58 with the hoist part of tension assembly 16 eliminated from above daisy wheel 24. Cart tube 12 is rigidly connected to top cart 59. Casters 36 are fastened to the bottom of top cart 59 and roll on center hole cart 58. Because center hole cart 58 contains a hole 58A, top cart 59 is able to achieve greater motion along center hole cart 58 than it could if there was no hole 58A. Center hole cart 58 rides on casters 36 attached to the topside of daisy wheel 24. FIG. 10 shows center hole cart 58 with casters 36 attached to its bottom side. However, there are no casters in-between center hole cart 58 and top cart 59. A further modification of this design would be to remove casters 36 from in-between daisy wheel 24 and center hole cart 58.

In other embodiments, the carts can be equipped with a prior art track attachment to permit a person using the system to exit a room equipped with the present invention and proceed to a room, hallway or stairway equipped with an overhead track system. The track system could be motorized, especially for stairways. For multi-story buildings an elevator can be equipped with the spoked rimless wheels in the ceiling of the elevator to permit persons to move from one floor to a higher or lower floor.

Slot Track Embodiment

Previous discussion has focused the utilization of the present invention in a room with an array of daisy wheels 24, as shown in FIG. 2A. In other words, daisy wheels 24 provided the riding surface for overhead cart 14. However, it is also possible, and in many cases desirable, to have a slot track as the riding surface. The slot track embodiment is described by reference to FIGS. 11A through 15. The advantage of using a slot track over a prior art track is that prior art tracks require the user to operate a switching means in order select which track to take whenever tracks intersect. The switching means tends to be complicated, costly and subject to failure. Also, as previously stated, to integrate the present invention with a prior art track would require fitting the overhead carts with a prior art track attachment, which would raise both the cost and weight of the present invention.

Figure 11A:
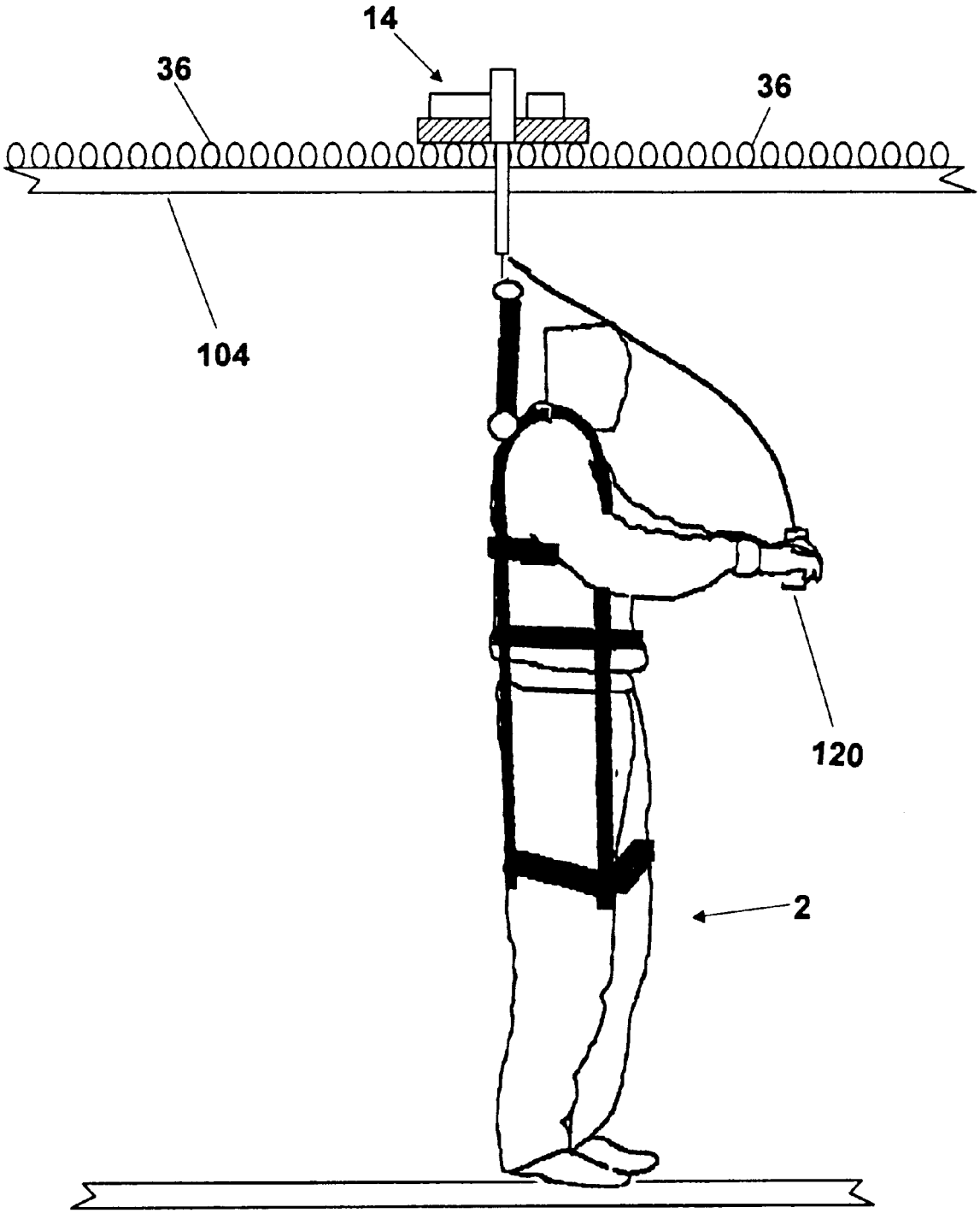
FIGS. 11A and 11B show the use of the present invention with a slot track embodiment.
Figure 12A:
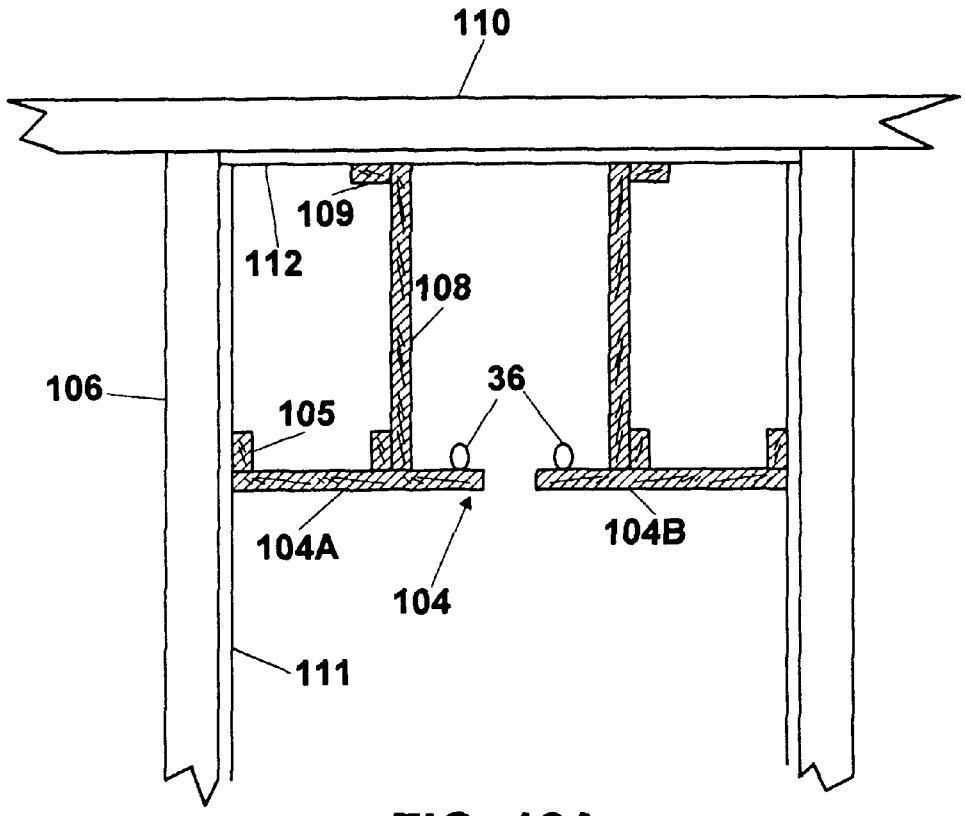
FIGS. 12A and 12B show a cross-section view of a slot track embodiment.
Figure 13A:
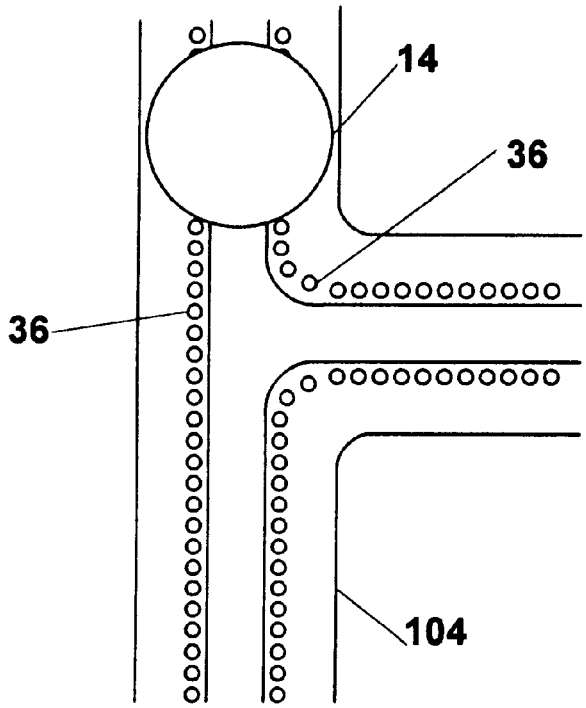
FIGS. 13A and 13B show the overhead cart on top of the slot track.

A first embodiment of the slot track version of the present invention is shown in FIG. 12A (side view) and FIG. 13A (top view). In FIG. 11A, person 2 is shown using the embodiment shown in FIGS. 12A and 13A. FIG. 11A shows overhead cart 14 rolling on casters 36. In this embodiment, casters 36 are mounted on both sides of slot track 104, as shown in FIGS. 12A and 13A. In the preferred embodiment, casters 36 are spaced 2 inches apart.

Figure 12B:
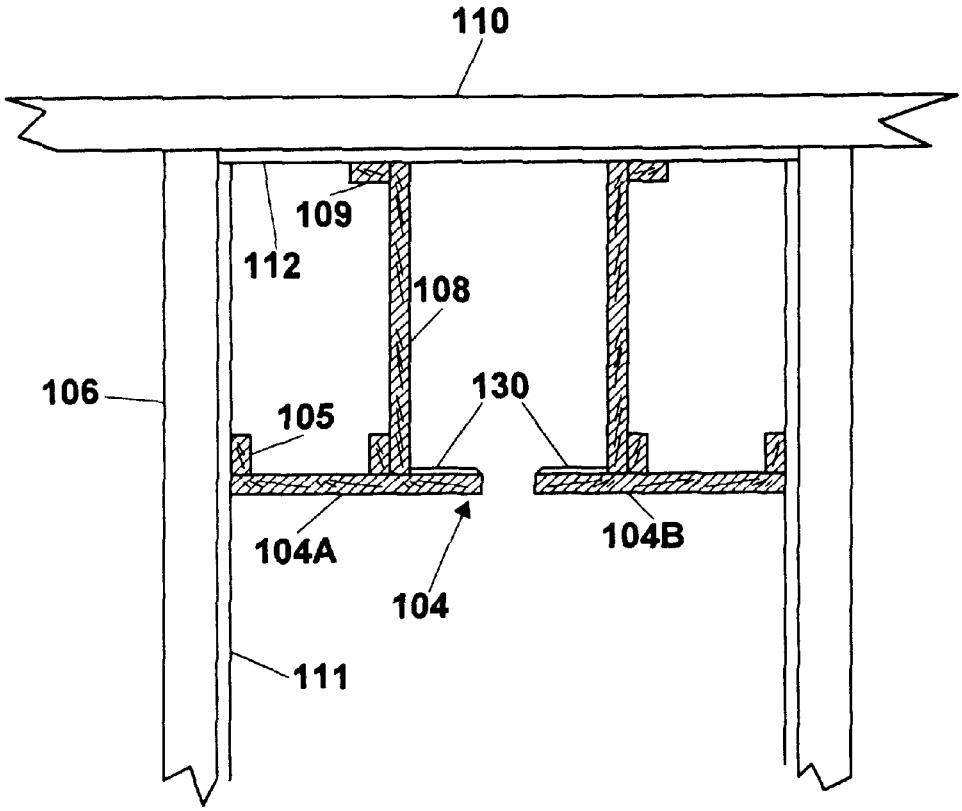

As shown in cross section view presented by FIGS. 12A and 12B, slot track 104 has a slot that is four inches wide and which is bordered one each side by plywood planks 104A and 104B that have a thickness of two inches. The length of the planks will vary depending on the length of the slot track desired. Slot track 104 is, supported horizontally by 2-inch× 4-inch boards 105 rigidly attached to slot track 104 and rigidly attached to wall studs 106. Slot track 104 is supported vertically by rigid attachment to 2-inch×4 inch boards 107, which in turn are rigidly attached to track support boards 108, which are in turn rigidly attached to 2-inch×4-inch boards 109, which are in turn rigidly attached to joists 110. In the preferred embodiment, boards 105 and 109 are rigidly attached to wall studs 106 and joists 110, respectively, by screws which can easily be screwed through dry wall 111 and ceiling 112.

Figure 15:
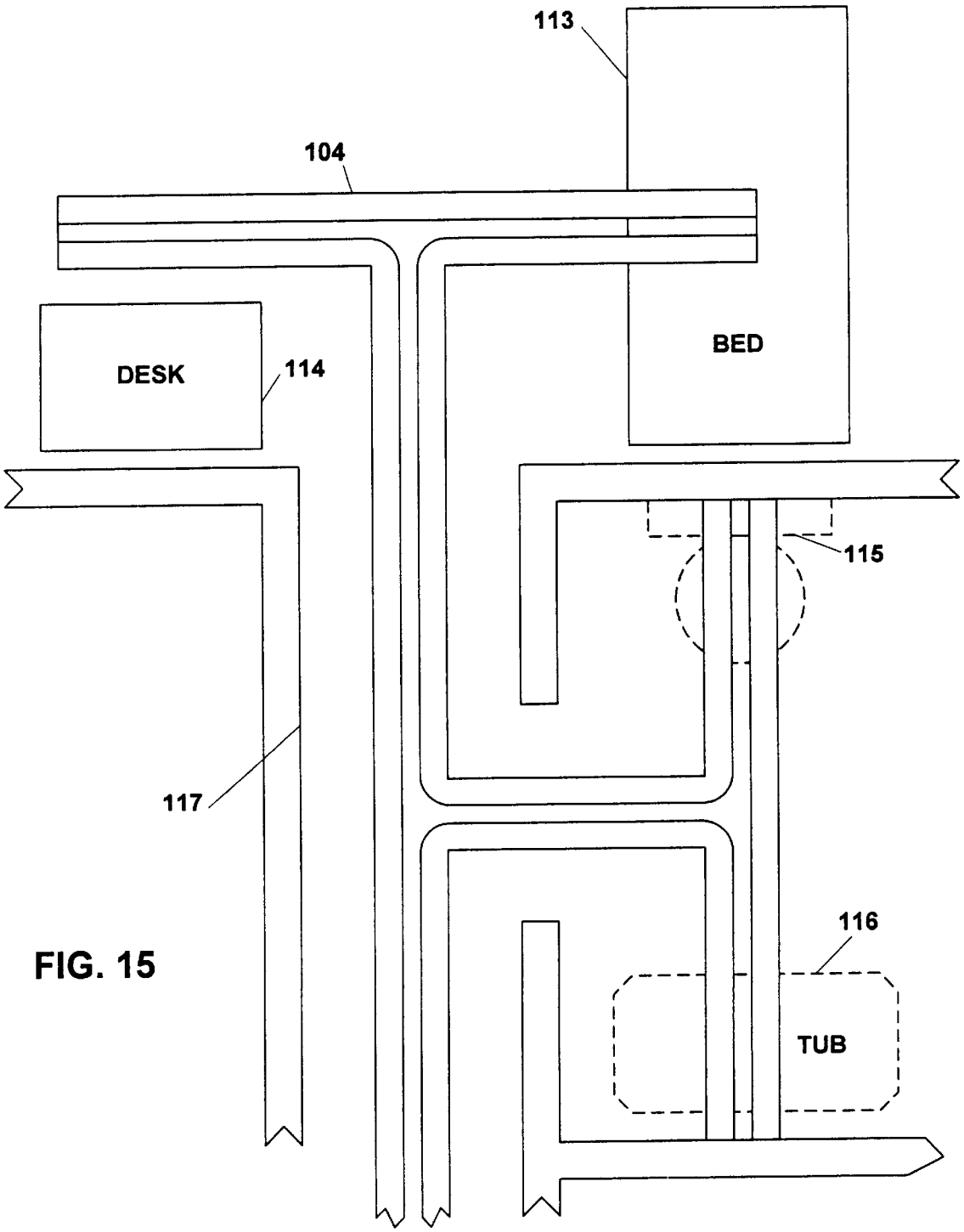
FIG. 15 shows a slot track installed to reach different locations in a residence.

The main advantage of slot track 104 is made clear by reference to FIGS. 13A and FIG. 15. FIG. 13A shows casters 36 mounted on the edge of slot track 104. Overhead cart 14 can remain going straight or turn, depending on the will of the user. Response is instantaneous and no switching mechanisms are required, unlike prior art systems. FIG. 15 better illustrates how the present embodiment could be utilized in a residence. Slot track 14 could be installed to allow movement between bed 113, desk 114, toilet 115, tub 116 and down the hallway 117. As previously stated, no switching mechanisms would be required at slot track intersections.

Slot Track Embodiment with Casters Mounted on Overhead Cart

Figure 11B:
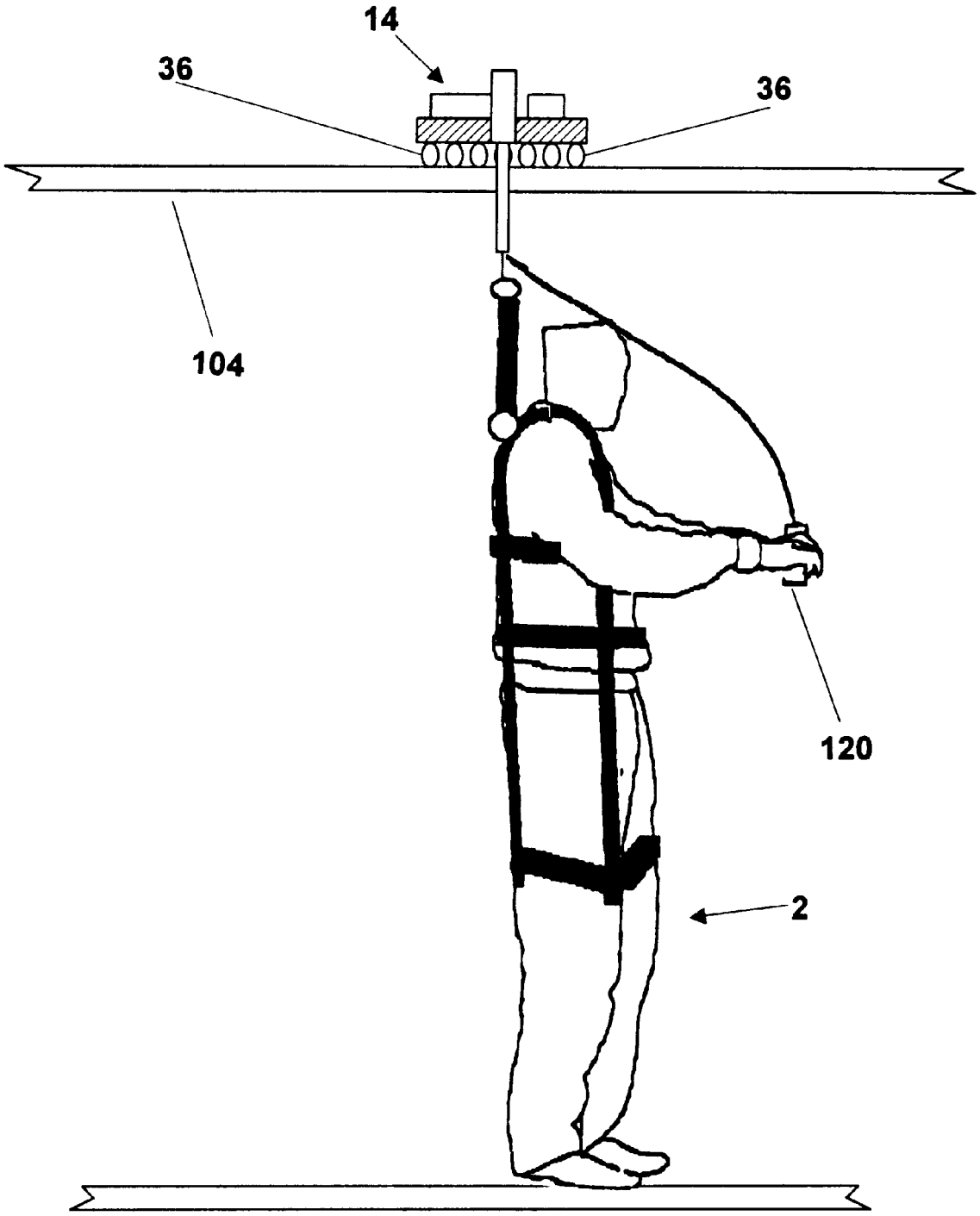
Figure 13B:
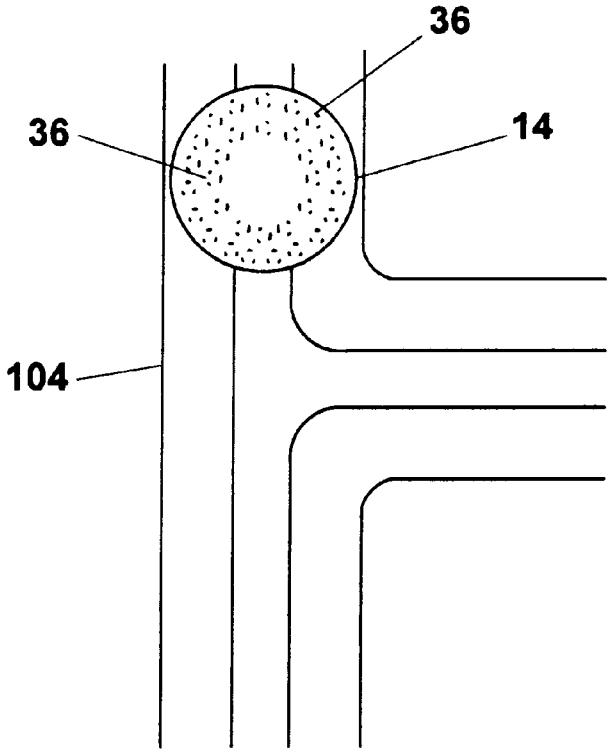

The slot track embodiment described above shows casters 36 mounted on slot track 104 and spaced 2 inches apart. However, it is also possible to mount casters 36 on overhead cart 14 and so that casters 36 roll on a smooth slot track, as shown in FIGS. 11B, 12B and 13B. The obvious advantage of this embodiment is that fewer casters are necessary and consequently, there is a tremendous financial savings.

Noise Dampening

Figure 14A:
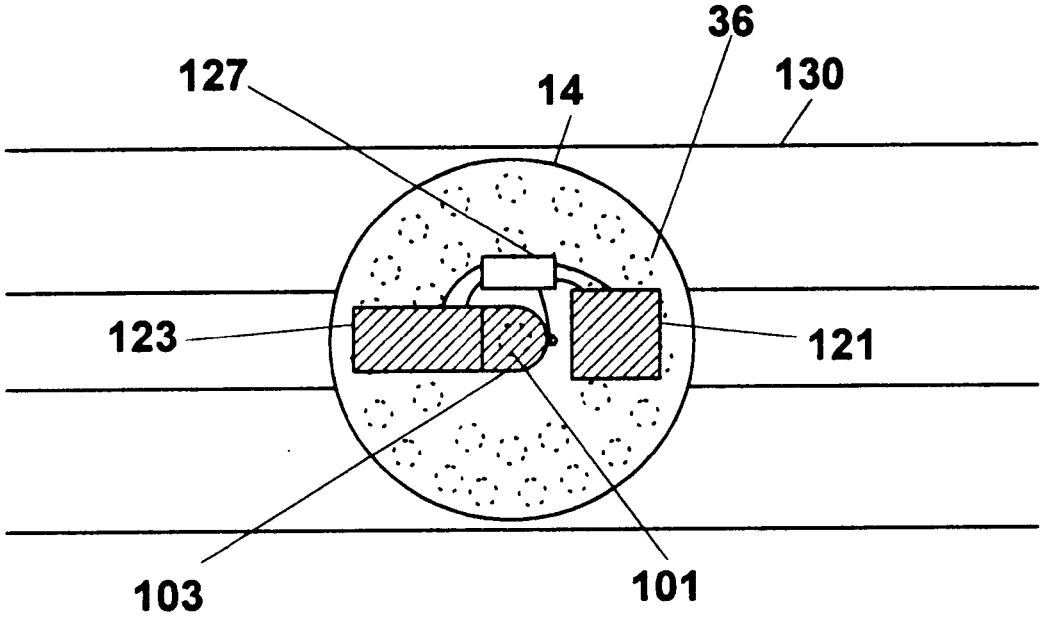
FIGS. 14A and 14B show an alternate hoist assembly.
Figure 14B:
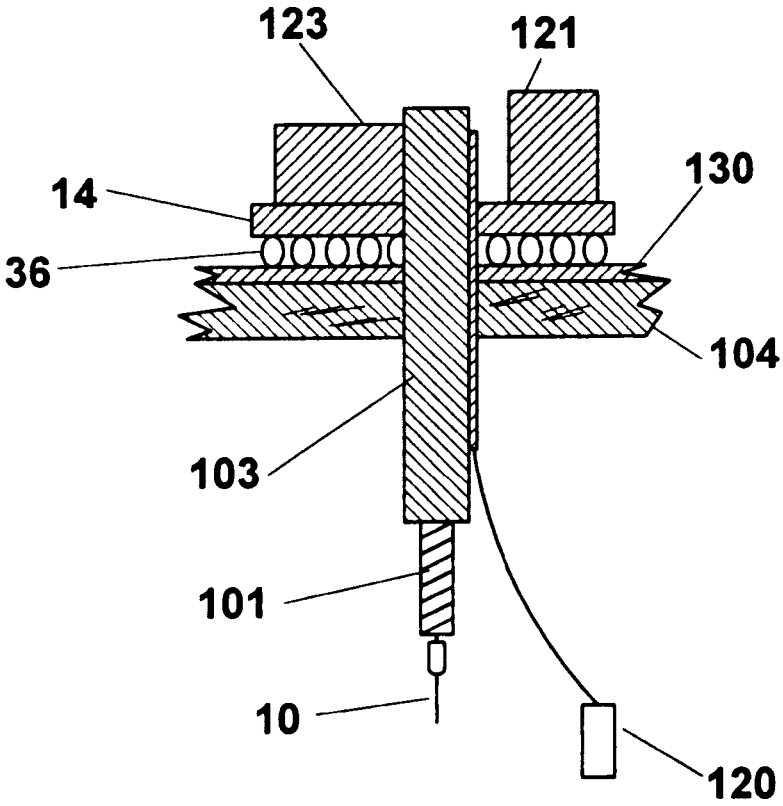

As overhead cart 14 is moved, casters 36 roll. Unfortunately, the rolling can be very noisy. It is, however, possible to dampen this unpleasant sound. Noise abatement material 130 can be placed in-between casters 36 and the opposing- surface. For example, as shown in FIGS. 12B and 14B noise abatement material 130 is glued to the top of slot track 104. It would also be possible to glue noise abatement material to the tops of daisy wheels 24. Conversely, it is possible to glue noise abatement material 130 to the bottom of overhead cart 14 in embodiments that have casters 36 attached to the sides of slot track 104 or the tops of daisy wheels 24. In the preferred embodiment, noise abatement material is made from polyurethane, part no. 8716K82. It is supplied by McMaster-Carr Supply Company with offices in Sante Fe Springs, Calif.

Combining the Slot Track Riding Surface with the Daisy Wheel Riding Surface

Another preferred embodiment is to combine in a single facility a slot track embodiment with an array of daisy wheels embodiment. For example, a residence could have a slot track configuration as described in FIG. 15 that takes the user through the hallway and selected rooms. Slot track 104 could also then take the user to a different room configured, such as the room shown in FIG. 2A, with an array of daisy wheels. An example of a room that might be set up with the daisy wheel array, would be a living room where the ability to move in random directions is more important than a hallway or a bathroom.

Alternate Hoist Assembly

An alternate hoist assembly 125 is described by reference to FIGS. 14A and 14B. Support cable 10 is pivotally connected to geared lifting rod 101. Geared lifting rod 101 is meshed inside support tube 103. Support tube 103 is rigidly connected to cart motor 123. Cart motor 123 and power source 121 are rigidly connected to overhead cart 14. Cart motor 123 is connected to geared lifting rod 101. Hand control unit 120 is electrically connected to controller 127. Controller 127 is also electrically connected to power source 121 and cart motor 123. In the preferred embodiment, power source 121 is a 12-volt DC dry cell battery rated at 22 Amps.

FIGS. 11A and 11B show person 2 operating hand control unit 120. As shown in FIGS. 14A and 14B, hand control unit 120 provides an electrical signal to controller 127. Controller 127 directs power from power source 121 to cart motor 123. Cart motor 123 then turns geared lifting rod 101 either clockwise or counterclockwise, depending on whether person 2 desires to be raised or lowered.

In a preferred embodiment, hoist assembly 125 is available as a linear actuator, part no. 5A702. It is manufactured by Dayton Electric Manufacturing Company with offices in Viles, Ill.

Applications

The present invention is valuable for many purposes. These include support for people with physical handicaps or people recovering from injury, joint replacements or surgery or people with a wide variety of diseases or disabling conditions such as Parkinson's, strokes or heart conditions. The invention can also be used to support animals or for the movement of equipment or toxic chemicals and it can be applied to assembly line production or meat processing. The present invention can be used by persons with no control at all over their legs. In this case the person's entire weight can be supported by the invention and he could provide the needed horizontal force by pulling or pushing on furniture or a special railing. Or if necessary the horizontal force could be provided by a hospital or nursing home attendant. Persons skilled in the art will recognize many other specific applications.

Persons skilled in this art will recognize many other changes and modifications which can be made to the present invention without departing from its spirit. Therefore, the scope of the present invention is to be determined by the appended claims and their legal equivalents.

I claim:

1. An overhead support system comprising:

A) an array of spoked rimless wheels located over a space, wherein said spoked rimless wheels are rotatably fixed in place, B) at least one overhead cart riding on said array of spoked rimless wheels, C) a tension element for supporting a load from said cart, wherein the load can be moved horizontally in random directions in the space by applying a horizontal force to the load causing said cart to move over said array of spoked rimless wheels carrying the load in the horizontal direction with at least a plurality of said spoked rimless wheels rotating to permit said tension element to pass horizontally through said array of spoked rimless wheels.

2. An overhead support system as in claim 1, wherein said spoked rimless wheels have the general shape of a multi-pointed ornamental star.

3. An overhead support system as in claim 2 and also comprising casters mounted on top of a plurality of said spoked rimless wheels to permit easy horizontal movement of the cart over said plurality of said spoked rimless wheels.

4. An overhead support system as in claim 1 wherein said spoked rimless wheels have the general shape of a daisy.

5. An overhead support system as in claim 1 and also comprising casters mounted on top of a plurality of said spoked rimless wheels to permit easy horizontal movement of the cart over said plurality of said spoked rimless wheels.

6. An overhead support system as in claim 5 wherein said at least one overhead cart defines a cart bottom, further comprising noise abatement material glued to said cart bottom.

7. An overhead support system as in claim 1 wherein said cart defines a cart bottom and further comprising a plurality of casters mounted on said bottom.

8. An overhead support system as in claim 7 wherein said array of spoked rimless wheels defines an array top, further comprising noise abatement material glued to said array top.

9. An overhead support system as in claim 1, further comprising a hoist means connected to said tension element.

10. An overhead support system as in claim 9, wherein said hoist means comprises:

A) a take-up axis,

B) a drive motor to rotate said take-up axis, and

C) a rechargeable battery to power said drive motor.

11. An overhead support system as in claim 9, wherein said hoist means comprises:

A) a cart motor rigidly connected to said at least one overhead cart,

B) a power source for supplying power to said cart motor,

C) a controller electrically connected to said cart motor, wherein said controller relays hoist commands from a user to said cart motor, and D) a geared lifting rod meshed with said cart motor and connected to said tension element, wherein said geared lifting rod can raise or lower said tension element in response to said hoist commands.

12. An overhead support system comprising:

A) a riding surface located over a space, wherein said riding surface comprises:

1) a slot track rigidly fixed in place, wherein said slot track defines a slot track top, and 2) an array of spoked rimless wheels rotatably fixed in place, wherein said array of spoked rimless wheels is adjacent to said slot track, wherein said at least one overhead cart is able to move horizontally between said array of spoked rimless wheels and said slot track, B) at least one overhead cart riding on said riding surface, C) a plurality of castors mounted between said riding surface and said at least one overhead cart, and D) a tension element for supporting a load from said at least one overhead cart, wherein the load can be moved horizontally in the space by applying a horizontal force to the load causing said at least one overhead cart to move over said riding surface carrying the load in the horizontal direction.

13. An overhead support system as in claim 12 wherein said at least one overhead cart defines a cart bottom, further comprising noise abatement material glued to said cart bottom.

14. An overhead support system as in claim 13 wherein said plurality of castors are mounted on said slot track top.

15. An overhead support system as in claim 14 further comprising noise abatement material mounted on said slot track top.

16. An overhead support system as in claim 12 wherein said at least one overhead cart defines a cart bottom, wherein said plurality of casters are mounted on said cart bottom.

17. An overhead support system as in claim 12, further comprising a hoist means connected to said tension element.

18. An overhead support system as in claim 17, wherein said hoist means comprises:

A) a take-up axis,

B) a drive motor to rotate said take-up axis, and

C) a rechargeable battery to power said drive motor.

19. An overhead support system as in claim 17, wherein said hoist means comprises:

A) a cart motor rigidly connected to said at least one overhead cart,

B) a power source for supplying power to said cart motor,

C) a controller electrically connected to said cart motor, wherein said controller relays hoist commands from a user to said cart motor, and D) a geared lifting rod meshed with said cart motor and connected to said tension element, wherein said geared lifting rod can raise or lower said tension element in response to said hoist commands.

20. An overhead support system as in claim 12, where said slot track is a plurality of intersecting slot tracks, wherein said at least one overhead cart can move between said plurality of intersecting slot tracks without the use of a switching device.

* * * * *